US009845221B2

(12) United States Patent
Hack

(10) Patent No.: US 9,845,221 B2
(45) Date of Patent: Dec. 19, 2017

(54) WINDING DEVICE FOR WINDING A MATERIAL TO BE WOUND AND METHOD FOR OPERATING A WINDING DEVICE FOR WINDING A MATERIAL TO BE WOUND

(71) Applicant: DIETZE & SCHELL MASCHINENFABRIK GMBH & CO. KG, Coburg (DE)

(72) Inventor: René Hack, Coburg (DE)

(73) Assignee: DIETZE & SCHELL MASCHINENFABRIK GMBH & CO. KG, Coburg (DE)

( * ) Notice: Subject to any disclaimer, the term of this patent is extended or adjusted under 35 U.S.C. 154(b) by 0 days.

(21) Appl. No.: 15/500,232

(22) PCT Filed: Jun. 24, 2015

(86) PCT No.: PCT/EP2015/064269

§ 371 (c)(1),
(2) Date: Jan. 30, 2017

(87) PCT Pub. No.: WO2016/023664

PCT Pub. Date: Feb. 18, 2016

(65) Prior Publication Data

US 2017/0260018 A1 Sep. 14, 2017

(30) Foreign Application Priority Data

Aug. 15, 2014 (DE) ..... 10 2014 111 706

(51) Int. Cl.
*B65H 67/04* (2006.01)

(52) U.S. Cl.
CPC ..... *B65H 67/0411* (2013.01); *B65H 67/0417* (2013.01)

(58) Field of Classification Search
CPC ..... B65H 67/0411; B65H 67/0417; B65H 19/223
See application file for complete search history.

(56) References Cited

U.S. PATENT DOCUMENTS 6,135,383 A 10/2000 Flamm et al.
2015/0175383 A1 6/2015 Seifert

FOREIGN PATENT DOCUMENTS

DE 195 05 838 A1 9/1995
DE 198 25 960 A1 12/1999
(Continued)

OTHER PUBLICATIONS

Search Report dated Jun. 5, 2015 issued in corresponding DE patent application No. 10 2014 111 706.9 (and partial English translation).
(Continued)

*Primary Examiner* — William E Dondero
(74) *Attorney, Agent, or Firm* — Posz Law Group, PLC

(57) ABSTRACT

A winding device for winding a material to be wound includes a winding mandrel provided for carrying a carrier of material to be wound in a winding process, with a transporting unit on which at least a component of the winding mandrel is arranged, and with a positioning unit provided for changing a spatial position of the transporting unit. The positioning unit is provided for at least substantially adjusting a spatial end position according to requirement. The transporting unit is embodied as a pivot arm, the transporting unit is in at least one operating state provided for receiving a carrier of material to be wound, wherein the material to be wound is wound onto the carrier of material to be wound and/or is wound off the carrier of material to be wound, and the transporting unit is in the winding operative position during the winding process.

12 Claims, 4 Drawing Sheets

(56) References Cited

FOREIGN PATENT DOCUMENTS

Figure 1:
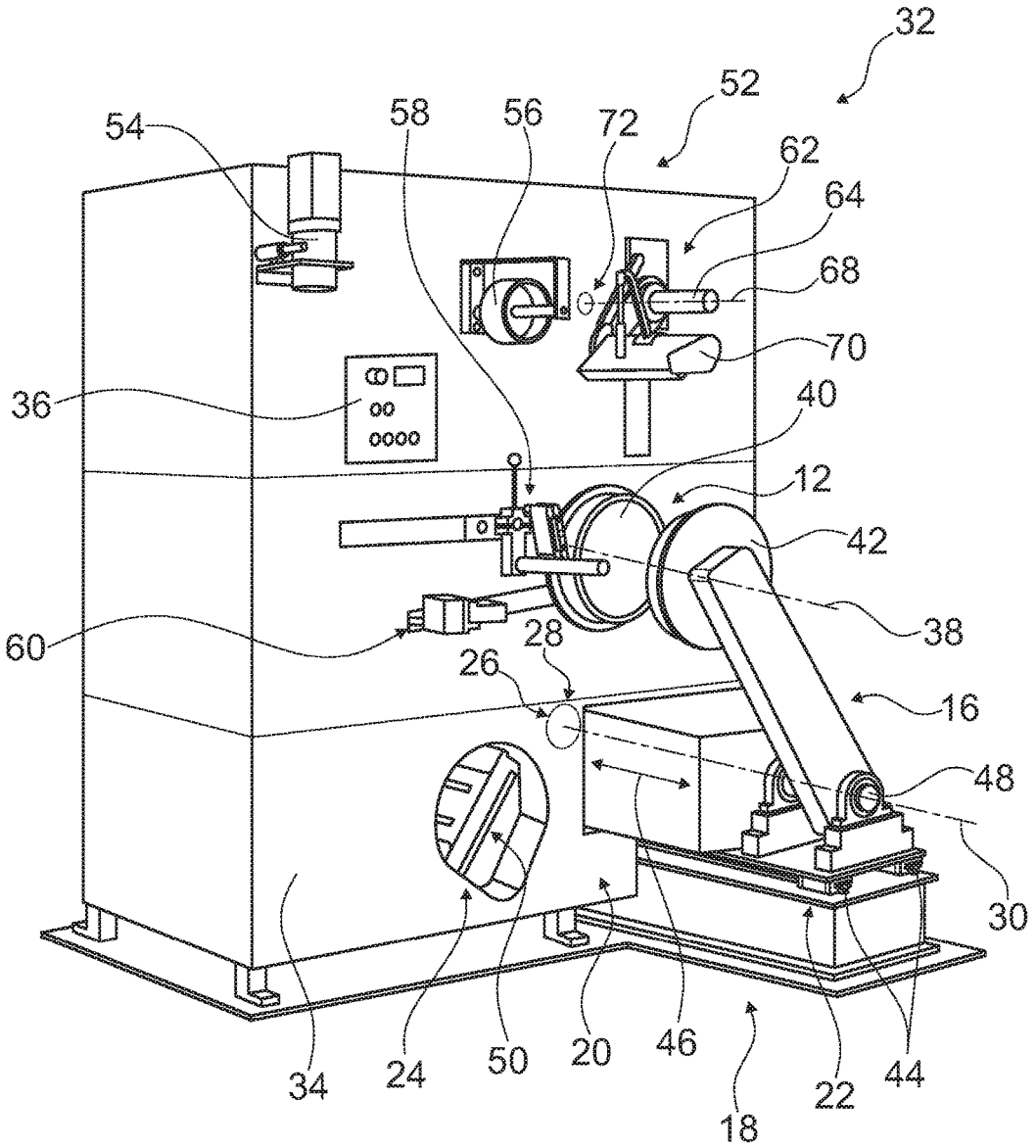

| | | | |
|---|---|---|---|
| DE | 101 51 310 | A1 | 5/2003 |
| DE | 20 2013 105 817 | U1 | 3/2014 |
| EP | 0 950 628 | A2 | 10/1999 |
| JP | H06-206665 | A | 7/1994 |
| WO | 2008/095982 | A1 | 8/2008 |

OTHER PUBLICATIONS

International Search Report of the International Searching Authority dated Aug. 31, 2015 issued in corresponding International patent application No. PCT/EP2015/064269.

International Preliminary Report on Patentability dated Jul. 7, 2016 issued in corresponding International patent application No. PCT/EP2015/064269 (and partial English translation).

WINDING DEVICE FOR WINDING A MATERIAL TO BE WOUND AND METHOD FOR OPERATING A WINDING DEVICE FOR WINDING A MATERIAL TO BE WOUND

CROSS REFERENCE TO RELATED APPLICATIONS

This application is a U.S. national stage application of PCT/EP2015/064269 filed on Jun. 24, 2015, which claims priority to German Patent Application No. DE 10 2014 111 706.9 filed on Aug. 15, 2014, the contents of which are incorporated herein by reference.

STATE OF THE ART

The invention relates to a winding device and to a method for operating a winding device.

From DE 20 2013 105 817 U1 a winding machine for winding material to be wound onto a tube is known, comprising a winding mandrel, which is fixated to a pivot arm provided for carrying the tube in a winding process, wherein the pivot arm is movable into two defined axial positions and pivotable into two defined pivot positions.

Moreover, winding devices for winding a material to be wound onto a tube are known from JP H06 206665 A and EP 0 950 628 A1, wherein winding mandrels of the winding devices carry out an axial movement for gripping carriers of material to be wound.

The objective of the invention is in particular to make a generic winding device available which has improved characteristics regarding flexibility.

Advantages of the Invention

The invention is based on a winding device for winding, in particular winding up, winding off and/or re-winding, a material to be wound, in particular onto an exchangeable carrier of material to be wound and/or from an exchangeable carrier of material to be wound, with a winding mandrel provided for carrying a carrier of material to be wound in a winding process, with a transporting unit on which at least a component of the winding mandrel is arranged, preferably fixated, and with a positioning unit provided for changing and/or preferably adapting a spatial position of the transporting unit, wherein the positioning unit is provided for at least substantially adjusting a spatial end position of the transporting unit according to requirement, wherein the transporting unit is embodied as a pivot arm.

It is proposed that the transporting unit is in at least one operating state provided for receiving a carrier of material to be wound which is arranged and is to be processed in a feed unit for carriers of material to be wound, and for transporting said carrier of material to be wound, via an axial translational movement and a pivot movement, into a winding operative position, wherein at least one winding process is carried out in which the material to be wound is wound onto the carrier of material to be wound and/or is wound off from the carrier of material to be wound, wherein the transporting unit is in the winding operative position during the winding process.

A "winding device" is in particular to mean, in this context, at least one component and/or sub-assembly of a winding machine. In particular, the winding device may also comprise the entire winding machine. In particular, the winding device may comprise a control unit, a feed unit for material to be wound, a feed unit for carriers of material to be wound, and/or at least one drive unit. A "feed unit for material to be wound" is herein in particular to mean a unit which is in at least one operating state provided for making the material to be wound available and in particular for feeding the material to be wound to the carrier of material to be wound. By a "material to be wound" is in particular a windable material to be understood, which may in particular be wound up for storage and/or for transport. The material to be wound may in particular be any kind of a material to be wound that is deemed expedient by someone skilled in the art, e.g. a thread, a wire and/or a ribbon, which may in particular be made of any material that is deemed expedient by someone skilled in the art, e.g. of plastic, metal, textile fibers and/or paper. Furthermore, a "carrier of material to be wound" is in particular to mean a carrier and/or body which is provided for receiving the material to be wound, in particular on an exterior surface, which is curved in a convex fashion in particular at least partly, preferably at least to a major part and especially advantageously entirely. Preferentially the carrier of material to be wound is embodied as a tube, in particular as a hollow body, preferably as a hollow cylinder, in particular having a circular-annulus shaped base area. Alternatively, however, it is also conceivable that a carrier of material to be wound is embodied as a full body, in particular as a full cylinder. The term "at least to a major part" is herein in particular to mean by at least 60%, advantageously by at least 70%, preferably by at least 80% and particularly preferentially by at least 90%.

By the term that the carrier of material to be wound is embodied "exchangeable" is in particular to be understood that the carrier of material to be wound is exchangeable and/or exchanged, in particular following complete processing, for a further carrier of material to be wound, which is in particular different from the carrier of material to be wound, preferably identical to the carrier of material to be wound. In particular, herein a processed, in particular completely processed carrier of material to be wound is exchanged for a further carrier of material to be wound that is to be processed. Preferably the further carrier of material to be wound, advantageously a plurality of further carriers of material to be wound, which are in particular identical to each other and are in particular to be processed, is arranged in the feed unit for carriers of material to be wound. In this context, a "processed" carrier of material to be wound is in particular to mean a carrier of material to be wound on which a pre-defined quantity of the material to be wound has been wound, in particular in a directly temporally preceding winding process, and/or from which a pre-defined quantity of the material to be wound has been wound off, in particular in a directly temporally preceding winding process. A carrier of material to be wound that is "to be processed" is herein in particular to mean a carrier of material to be wound onto which a pre-defined quantity of the material to be wound is to be wound, in particular in a directly temporally subsequent winding process, and/or from which a pre-defined quantity of the material to be wound is to be wound off, in particular in a directly temporally subsequent winding process. Moreover, a "feed unit for carriers of material to be wound" is in particular to mean a unit which is in particular provided for storing carriers of material to be wound which are to be processed. "Provided" is in particular to mean specifically programmed, designed and/or equipped. By an object being provided for a certain function is in particular to be understood that the object fulfills and/or carries out said certain function in at least one application state and/or operation state.

Preferably the winding mandrel is embodied as a clamping mandrel and is in particular provided for receiving the carrier of material to be wound, in particular by means of a form-fit connection, a friction-fit connection and/or preferentially a force-fit connection, in particular by means of at least one clamping jaw. The winding mandrel is furthermore advantageously embodied rotatable and is in particular provided for transferring a rotary movement and/or a torque, in particular about a winding axis, onto the carrier of material to be wound, in particular via the form-fit connection, the friction-fit connection and/or preferably the force-fit connection. For this purpose the winding device comprises in particular a drive unit, which is provided to put the winding mandrel into a rotary motion in at least one operating state, in particular during the at least one winding process. By a "winding axis" is in particular, in this context, an axis to be understood about which a rotation of the winding mandrel and/or of the carrier of material to be wound may be executable, in particular for the purpose of winding up and/or winding off the material to be wound.

Furthermore, by a "transporting unit" in particular a unit is to be understood which is in at least one operating state provided for carrying, in particular completely carrying, and in particular moving and/or transporting, in particular moving and/or transporting from at least one place to at least one further place, which in particular differs from the at least one place, the carrier of material to be wound, in particular a processed carrier of material to be wound and/or a carrier of material to be wound that is to be processed. Herein the transporting unit is preferably provided for being moved, in particular via the positioning unit, into a defined position, in particular an end position, in at least one operating state. The transporting unit is herein preferably supported in such a way that it is mobile and/or movable along a straight line and/or pivotable about a pivot axis. In this context, a "position" is in particular to mean a position of the transporting unit, preferably an axial position and/or a position that is linearly offset to a start position, and/or an orientation, in particular a pivot position, of the transporting unit. Moreover an "end position" is in particular to mean a position of the transporting unit in which a movement of the transporting unit stops and/or in which at least one process, e.g. the winding process, a setting-down process and/or a receiving process, is implemented. By a "winding process" is in particular, in this context, a process to be understood in which the material to be wound is wound onto the carrier of material to be wound and/or wound off from the carrier of material to be wound, in particular by the winding machine device. A "setting-down process" is in particular to be understood, in this context, as a process in which the carrier of material to be wound and/or a further carrier of material to be wound is removed and/or transported away out of the winding device. Preferably the setting-down process is effected temporally directly subsequently to the winding process. By a "receiving process" is in particular, in this context, a process to be understood in which the carrier of material to be wound and/or a further carrier of material to be wound is delivered to the winding device. Preferentially the receiving process is effected temporally directly preceding the winding process.

The positioning unit comprises in particular at least one positioning element, which is provided for adjusting the position of the transporting unit. Herein the at least one positioning element preferably comprises a further drive unit, which is in particular embodied differing from the drive unit, and in particular a gearing, which is in particular connected to the further drive unit and/or to the transporting unit directly and/or indirectly. The drive unit and/or the further drive unit may herein be embodied as any kind of drive unit deemed expedient by someone skilled in the art, e.g. as a manual drive and/or treadle drive, combustion engine, Stirling engine, hydraulic engine and/or preferentially as an electromotor. The gearing may furthermore be embodied as any kind of gearing deemed expedient by someone skilled in the art, e.g. as a hydraulic, pneumatic and/or preferably mechanical gearing. In particular, the at least one positioning element may also comprise a plurality of drive units and/or gearings. Preferentially the positioning unit is herein free of a mechanical stop.

By a "mechanical stop" is herein in particular a structural component to be understood which is specifically designed to implement a stop for an object. Herein the mechanical stop in particular differs from a floor, a wall, a machine housing, in particular a winding machine housing, and/or a latticing, in particular for fencing around the winding machine. The term "adapting" is in particular to mean optimizing and/or bringing in line with an advantageous operation. A "maximally possible moving space of the transporting unit" is in particular to mean a moving space of the transporting unit in a fully functional state of the winding device. By the term "at least substantially any kind" is in particular to be understood any kind in the range of a resolution precision of the positioning unit and/or of the transporting unit and/or at least substantially continuously variable. The term "at least substantially continuously variable" is in particular to mean, in this context, a setting with at least 10, advantageously at least 50, preferably at least 100 and particularly preferably at least 500 steps and/or positions, which are preferentially distributed equally, in particular in a defined range, advantageously in an angle range between 0° and 360°, preferably in an angle range between 10° and 180°, and/or in a length range between 0 cm and 1 m, especially preferentially in a range of the maximally possible moving space of the transporting unit. The winding machine device may moreover in particular also comprise a plurality of carriers of material to be wound, winding mandrels, transporting units, feed units for material to be wound, feed units for carriers of material to be wound and/or positioning units.

By this implementation a generic winding device may be rendered available, which has improved characteristics regarding flexibility. In particular, an adjusting effort, in particular of possible mechanical stops, in particular when changing a size of a carrier of material to be wound and/or changing a size of a material to be wound, may be minimized.

In case the transporting unit is embodied as a pivot arm, a stable, structurally simple transporting unit may be rendered available.

Preferentially the positioning unit comprises a first positioning element, which is provided for changing an axial position of the transporting unit and for adjusting, in particular at least substantially adjusting according to requirement, an axial position of the transporting unit. Preferably the first positioning element herein comprises a gearing which converts a rotary movement into a translational movement, e.g. a trapezoid thread spindle and/or preferentially a ball screw. This advantageously allows simple and precise adjusting of any kind of axial position of the transporting unit.

If the positioning unit comprises a second positioning element, which is provided for changing a pivot position of the transporting unit and for adjusting, in particular at least substantially adjusting according to requirement, a pivot position of the transporting unit, a movement repertoire of the transporting unit and thus in particular a versatility of the winding device may be improved. Furthermore any desired pivot position is achievable. It is in particular also conceivable, in this context, that the first positioning element and the second positioning element are embodied at least partly in a one-part implementation. By a first object and a second object being embodied "at least partly in a one-part implementation" is in particular to be understood, in this context, that the first object and the second object share at least one structural component.

In one implementation of the invention it is proposed that a maximum pivot angle of the pivot unit is at least 10°, advantageously at least 40°, preferably at least 60° and particularly preferentially at least 100°, and in particular no more than 360°, advantageously maximally 320°, preferably maximally 280° and particularly preferably no more than 220°. This in particular allows making an advantageously flexible transporting unit available.

The positioning unit is in particular provided for translationally displacing the transporting unit from a winding operative position into a setting-down operative position. By a "winding operative position" is in particular, in this context, an end position and/or a place to be understood in which the at least one winding process is effected. By a "setting-down operative position" is in particular, in this context, an end position and/or a place to be understood in which the transporting unit is provided for setting down the processed, in particular fully processed, carrier of material to be wound, in particular for receiving and/or storing the processed, in particular fully processed, carrier of material to be wound. Preferably a pivot angle of the transporting unit between the winding operative position and the setting-down operative position is at least 10°, preferentially at least 40° and particularly preferably at least 80°. Furthermore, by a "storage place for carriers of material to be wound" is in particular an object to be understood which is in particular provided for receiving and/or storing processed carriers of material to be wound, in particular fully processed carriers of material to be wound. This allows in particular providing a compact winding machine. It moreover allows advantageously saving on structural components, as an additional exchange unit for carriers of material to be wound may be dispensed with.

Preferably the transporting unit is in at least one operating state, in particular a further operating state, which is in particular different from the operating state, in particular a receiving process, provided for receiving and/or gripping, in particular via the form-fit and/or preferably the force-fit connection, in particular directly from the feed unit for carriers of material to be wound, a carrier of material to be wound that is arranged in the feed unit for carriers of material to be wound and is to be processed, and for transporting said carrier of material to be wound, arranged in the feed unit for carriers of material to be wound and to be processed, into a winding operative position, in particular via an axial translational movement and/or a pivot movement. In particular, the positioning unit is provided for translationally displacing the transporting unit from a receiving operative position into a winding operative position. A "receiving operative position" is in particular to mean an end position and/or a place in which the transporting unit is provided fro receiving the carrier of material to be wound that is to be processed. Preferably a pivot angle of the transporting unit between the receiving operative position and the winding operative position is at least 10°, preferably at least 40° and especially preferentially at least 80°. Preferentially a pivot angle of the transporting unit between the receiving operative position and the setting-down operative position is at least 10°, advantageously at least 40°, preferably at least 80° and particularly preferably at least 160°. In this way in particular a flexibility may be further increased and a construction space required for the winding machine is further reducible, as a result of which a compact, in particular simply structured winding machine may be rendered available, comprising a reduced number of structural components. Moreover advantageously a susceptibility to failure may be minimized and costs may be reduced.

It is also proposed that the winding mandrel comprises a first mandrel unit and a second mandrel unit, wherein the first mandrel unit is fixated, preferably directly fixated, to a winding machine housing of the winding device and/or of the winding machine, and the second mandrel unit is arranged on, in particular fixated to, preferably directly fixated to the transporting unit. In this context, a "mandrel unit" is in particular to mean a unit which forms at least part of the winding mandrel. Preferably the first mandrel unit and the second mandrel unit are embodied separate from each other. Herein the first mandrel unit and the second mandrel unit are advantageously introducible into the carrier of material to be wound from opposite sides. By the first mandrel unit and the second mandrel unit being "introducible into the carrier of material to be wound from opposite sides" is in particular to be understood, in this context, that the first mandrel unit and the second mandrel unit are movable into the carrier of material to be wound in opposite directions, in particular at least substantially along the winding axis. Herein the first mandrel unit and the second mandrel unit in particular form the winding mandrel in a state when fully introduced in the carrier of material to be wound. This advantageously allows increasing an operative velocity and/or improving operability, in particular handling of the carriers of material to be wound.

It is further proposed that the positioning unit comprises a first position capturing unit, which is provided for capturing an axial position of the transporting unit and/or position of the transporting unit that is linearly offset, in particular with respect to a starting position. By a "position capturing unit" is herein in particular a sensor unit to be understood, which is in at least one operating state provided for detecting and/or sensing a position of the transporting unit. Preferably the position capturing unit is provided to make an actual position of the transporting unit available as a digital output signal and in particular to feed said actual position of the transporting unit to the control unit. The control unit is herein in particular provided to compare the actual position and/or the digital output signal to a required position of the transporting unit, which is preferably stored in a memory unit of the control unit, and in particular to control the positioning unit in an appropriate manner. Preferentially the required position is herein equivalent to an end position of the transporting unit. An "actual position" is in particular to mean, in this context, an instantaneous position of the transporting unit. The position capturing unit may herein be embodied as any kind of position capturing unit that is deemed expedient by someone skilled in the art, e.g. as a laser sensor, in particular as a laser tracking sensor, as a magnetic sensor, as a gyro sensor, as a tilt sensor, as an azimuth sensor and/or preferably as a rotary encoder and/or angle position encoder. In this way in particular an axial position of the transporting unit may be captured and adapted to a required value.

In a preferred embodiment of the invention it is proposed that the positioning unit comprises a second position capturing unit, which is preferably identical to the first position capturing unit and is provided for capturing a pivot position of the transporting unit. In this way in particular a pivot position of the transporting unit may be captured and adapted to a required value.

If the first position capturing unit and the second position capturing unit are embodied at least partly in a one-part implementation, in particular costs may be saved and a required construction space is reducible. In particular, the first position capturing unit and the second position capturing unit may also be embodied in a one-part implementation. In this context, "embodied in a one-part implementation" is in particular to mean that the winding device comprises exactly one position capturing unit, which is provided for capturing an axial position as well as a pivot position of the transporting unit.

In a particularly preferred embodiment of the invention it is proposed that at least one of the position capturing units, in particular the first position capturing unit and/or the second position capturing unit, is arranged on a pivot axis of the transporting unit. By "a position capturing unit being arranged on a pivot axis of the transporting unit" is in particular to be understood that the position capturing unit touches and/or intersects with the pivot axis in at least one point, at least in a viewing direction that is perpendicular to the pivot axis. Preferentially the at least one point herein is herein at least equivalent to a center point of the position capturing unit. This advantageously allows simplifying a control algorithm and saving construction space.

Moreover an advantageously simple capturing may be effected if at least one of the position capturing units, in particular the first position capturing unit and/or the position capturing unit, is embodied as an absolute-value encoder.

In a further implementation of the invention it is proposed that at least one of the position capturing units, in particular the first position capturing unit and/or the second position capturing unit, is embodied as a relative-value encoder, in particular an incremental encoder. This in particular allows rendering an especially cost-efficient solution available.

The invention is furthermore based on a method for operating a winding device for winding a material to be wound, with a winding mandrel provided for carrying a carrier of material to be wound in at least one winding process, and with a transporting unit on which at least a component of the winding mandrel is arranged, wherein a spatial position of the transporting unit is changed, in particular by means of a positioning unit of the winding device, wherein a spatial end position of the transporting unit is at least substantially adjusted according to requirement, wherein the transporting unit is embodied as a pivot arm.

It is proposed that the transporting unit, in at least one operating state, receives a carrier of material to be wound which is arranged and is to be processed in a feed unit for carriers of material to be wound, and transports, via an axial translational movement and a pivot movement, said carrier of material to be wound into a winding operative position in which at least one winding process is carried out, wherein the material to be wound is wound onto the carrier of material to be wound and/or is wound off from the carrier of material to be wound, wherein the transporting unit is in the winding operative position during the winding process. This allows improving flexibility and advantageously minimizing an adjusting effort.

The winding device according to the invention is herein not to be restricted to the application and implementation form described above. In particular, the winding device according to the invention may, for fulfilling a functionality herein described, comprise a number of respective elements, structural components and units that differs from a number herein mentioned.

DRAWINGS

Further advantages will become apparent from the following description of the drawings. The drawings show an exemplary embodiment of the invention. The drawings, the description and the claims contain a plurality of features in combination. Someone skilled in the art will purposefully also consider the features separately and will find further expedient combinations.

Figure 2:
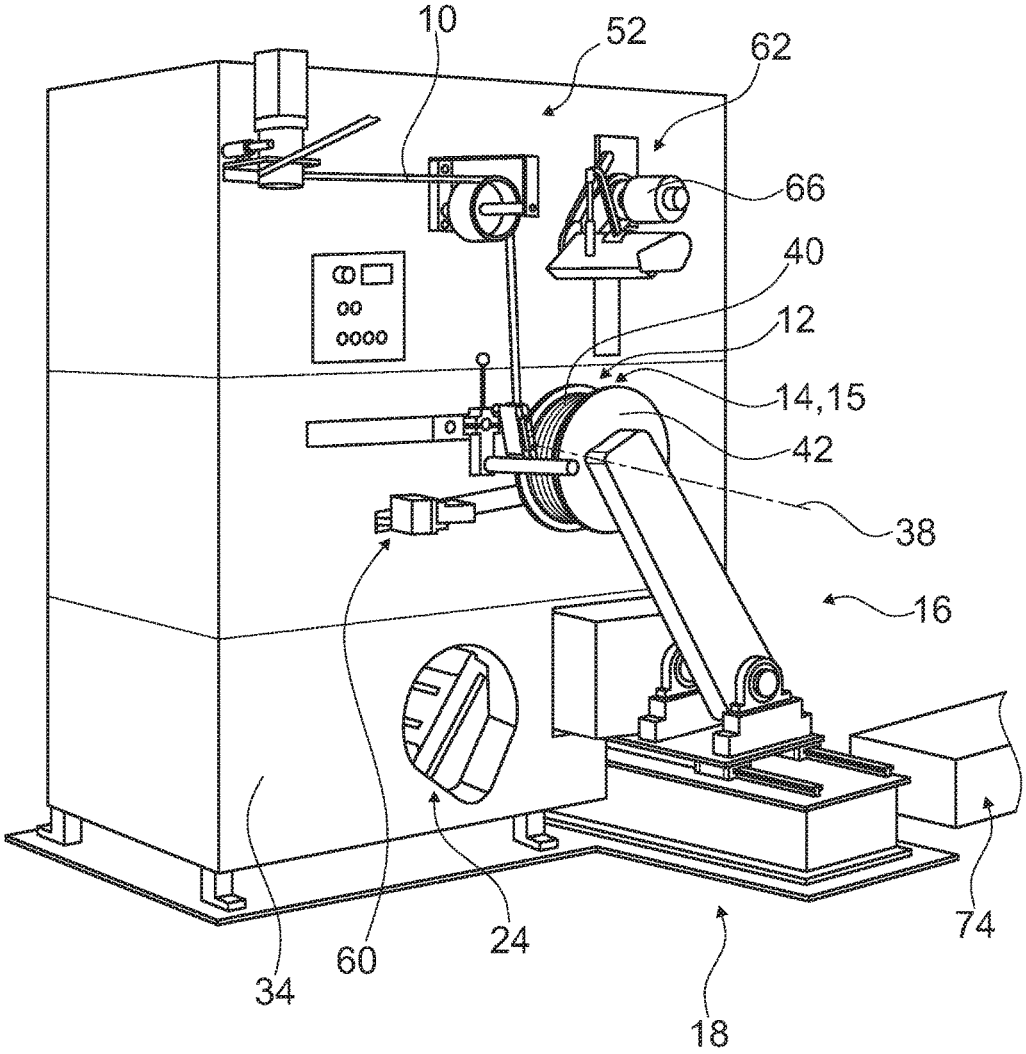
Figure 3:
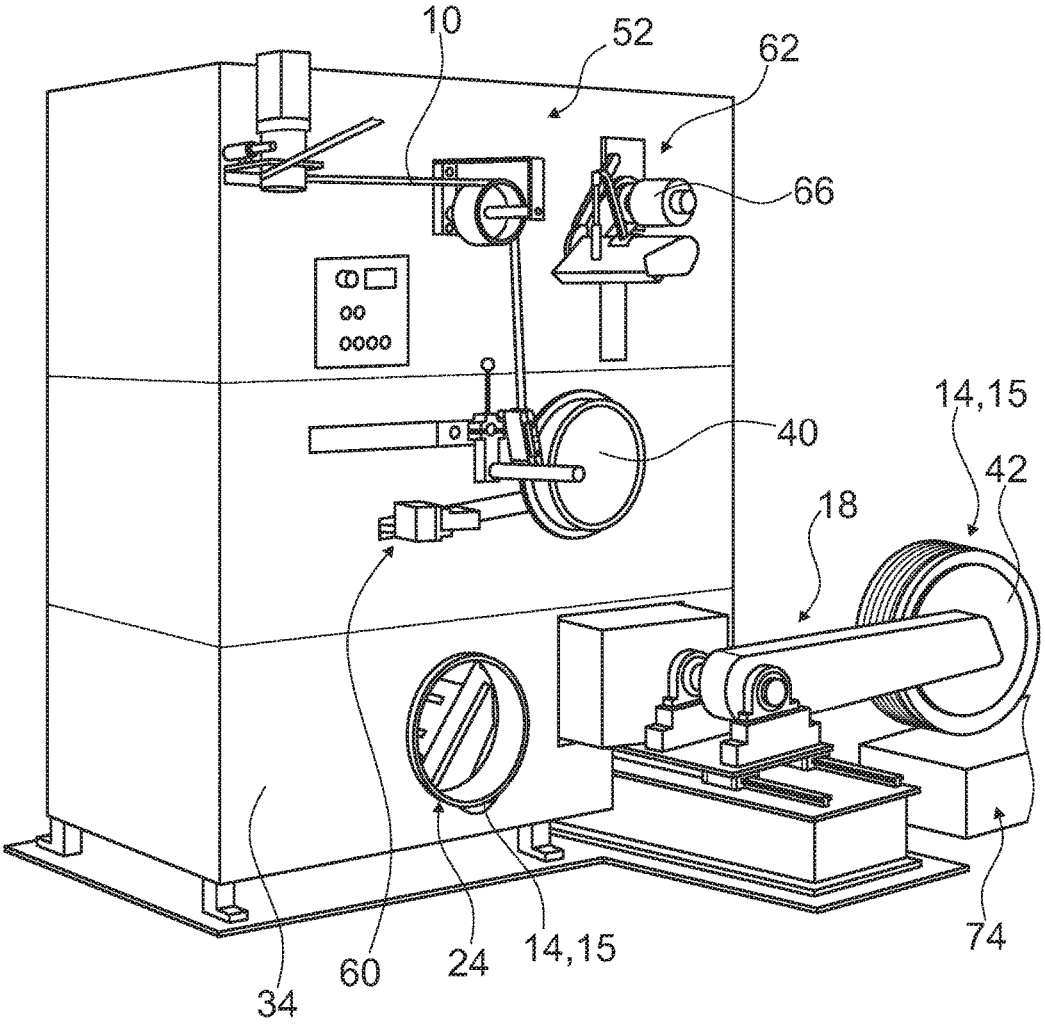

It is shown in:

FIG. 1 a winding machine with a winding device, in a perspective view,

FIG. 2 the winding device during a winding process,

FIG. 3 the winding device during a setting-down process, and

Figure 4:
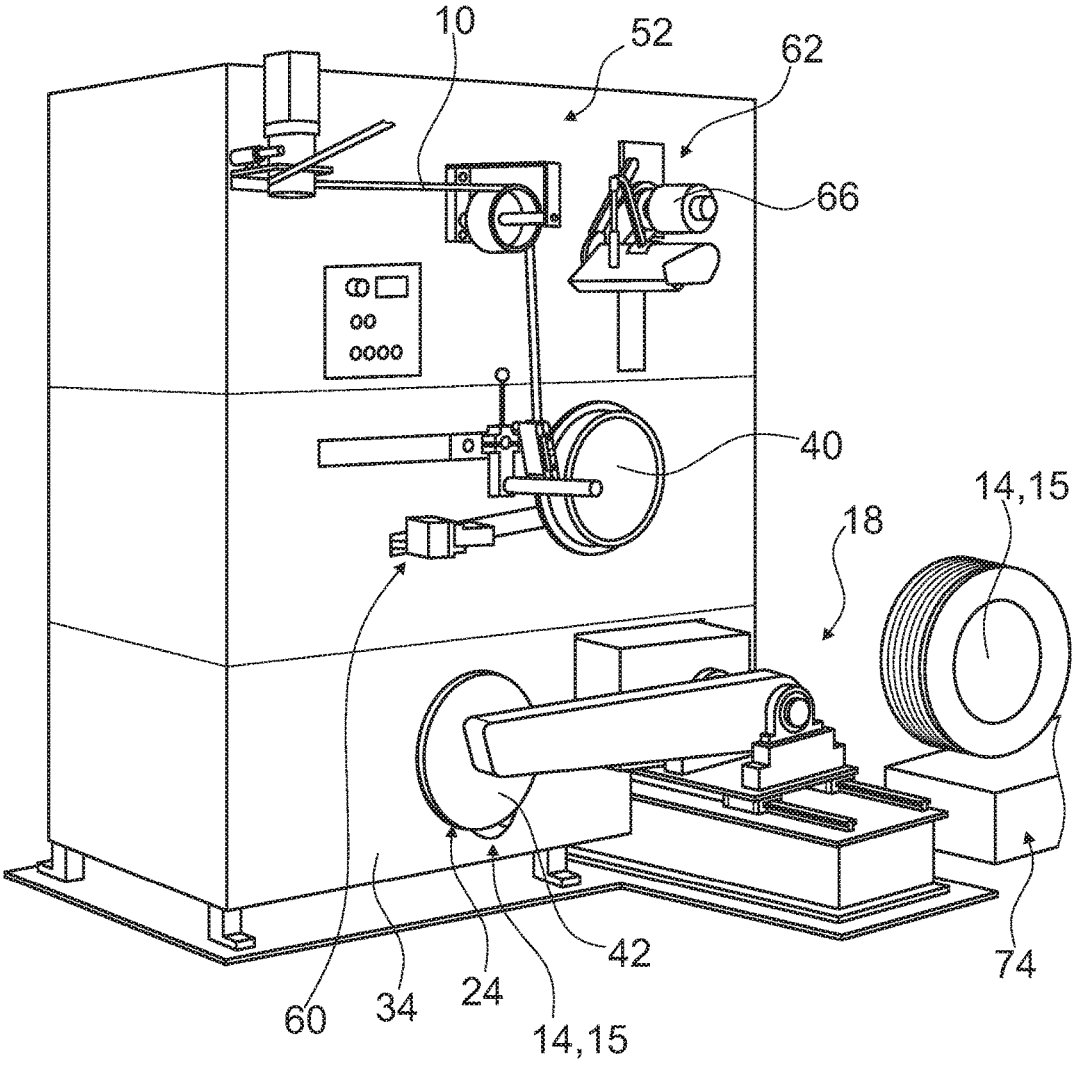

FIG. 4 the winding device during a receiving process.

DESCRIPTION OF THE EXEMPLARY EMBODIMENT

FIG. 1 shows an exemplary winding machine 32 in a perspective view. The winding machine 32 comprises a winding machine housing 34. The winding machine 32 comprises a winding device. For the purpose of controlling an operation of the winding machine 32, the winding device comprises a control unit (not shown). The control unit comprises a computing unit, a memory unit as well as an operating program which is stored in the memory unit and provided to be executed by the computing unit. Furthermore the winding device comprises an operating unit 36 for entering process parameters and/or for an operator selecting an operating program stored in the memory unit. The operating unit 36 is in contact with the control unit, e.g. via an electrical connection and/or a radio connection.

The winding device also comprises a winding mandrel 12. The winding mandrel 12 is embodied cylinder-shaped. The winding mandrel 12 is made of stainless steel. The winding mandrel 12 is moreover embodied rotatable. The winding mandrel 12 is supported rotatably about a winding axis 38. The winding mandrel 12 is embodied as a clamping mandrel. Hence the winding mandrel 12 comprises a plurality of clamping jaws (not shown). The winding mandrel 12 is in at least one operating state provided for carrying a carrier of material to be wound 14, 15 via a force-fit connection (cf. also FIG. 2). The winding device further comprises a drive unit (not shown). The drive unit is provided to put the winding mandrel 12 into a rotary movement during a winding process and to transmit the torque thus generated onto the carrier of material to be wound 14, 15. In the present case the winding mandrel 12 is furthermore embodied in a two-part implementation. The winding mandrel 12 comprises a first mandrel unit 40. The first mandrel unit 40 is embodied cylinder-shaped. The first mandrel unit 40 forms a first half of the winding mandrel 12. The first mandrel unit 40 is fixated to the winding machine housing 34. The first mandrel unit 40 is in the present case free of clamping jaws. Alternatively, however, a first mandrel unit 40 could comprise at least one clamping jaw. The winding mandrel 12 comprises a second mandrel unit 42. The second mandrel unit 42 is embodied cylinder-shaped. The second mandrel unit 42 forms a second half of the winding mandrel 12. The second mandrel unit 42 comprises a plurality of clamping jaws. The first mandrel unit 40 and the second mandrel unit 42 are in least one operating state provided to be introduced into the carrier of material to be wound 14, 15 from opposite sides. The first mandrel unit 40 and the second mandrel unit 42 are in the present case provided to be introduced into the carrier of material to be wound 14, 15 from opposite sides in a temporally offset fashion.

Furthermore the winding device comprises a transporting unit 16. The transporting unit 16 is embodied as a pivot arm. The transporting unit 16 is made of stainless steel. A component of the winding mandrel 12 is arranged on the transporting unit 16. In the present case the second mandrel unit 42 is fixated to the transporting unit 16. Alternatively it is also conceivable to embody a winding mandrel in a one-part implementation, and in particular to entirely fixate said winding mandrel to a transporting unit. The transporting unit 16 is further supported movably. The transporting unit 16 is in the present case supported on rails 44. The transporting unit 16 is supported in such a way that it is displaceable in an axial direction 46. The transporting unit 16 is herein displaceable along a straight line. The transporting unit 16 is in the present case displaceable in parallel and/or along the winding axis 38. Consequently an axial position of the transporting unit 16 is changeable. In addition, the transporting unit 16 is supported on a rotary shaft 48. Thereby the transporting unit 16 is supported in such a way that it is pivotable about a pivot axis 30. The pivot axis 30 extends in parallel to the winding axis 38. Consequently a pivot position of the transporting unit 16 is changeable. A maximum pivot angle of the transporting unit 16 is in the present case approximately 190°. Alternatively it is also conceivable to implement a transporting unit in such a way that an axial position or a pivot position of the transporting unit is not changeable.

Beyond this the winding device comprises a positioning unit 18. The positioning unit 18 is provided for changing a spatial position of the transporting unit 16. In the present case the positioning unit 18 is provided for at least substantially adjusting a spatial end position of the transporting unit 16 according to requirement. For this purpose the positioning unit 18 comprises at least one positioning element 20, 22. In the present case the positioning unit 18 comprises two positioning elements 20, 22. The positioning elements 20, 22 are provided, in a well-known fashion, to adjust the position of the transporting unit 16. The first positioning element 20 is provided for changing the axial position of the transporting unit 16. The first positioning element 20 comprises a first drive unit (not shown), which is embodied as an electromotor. Moreover the first positioning element 20 comprises a ball screw (not shown), which is provided to convert a rotary movement of the first drive unit into a translational movement of the transporting unit 16. The second positioning element 22 is provided for changing the pivot position of the transporting unit 16. The second positioning element 22 comprises a second drive unit (not shown), which is embodied as an electromotor. The second positioning element 22 further comprises a gearing (not shown), which is provided for converting a rotary movement of the second drive unit into a pivot movement of the transporting unit 16. Alternatively it is conceivable that a first positioning element and a second positioning element are embodied at least partly in a one-part implementation and/or in a one-part implementation. It is moreover conceivable to use any other kind of positioning elements deemed expedient by someone skilled in the art, e.g. at least one pneumatic and/or at least one hydraulic positioning element.

For the purpose of capturing a position of the transporting unit 16, the positioning unit 18 further comprises at least one position capturing unit 26, 28. In the present case the positioning unit 18 comprises two position capturing units 26, 28. The first position capturing unit 26 is provided for capturing the axial position of the transporting unit 16. The first position capturing unit 26 is arranged on the pivot axis 30. The first position capturing unit 26 is at least partly fixated to the rotary shaft 48. The first position capturing unit 26 is embodied as a rotary encoder. In the present case the first position capturing unit 26 is embodied as an absolute-value encoder. The second position capturing unit 28 is provided for capturing the pivot position of the transporting unit 16. The second position capturing unit 28 is arranged on the pivot axis 30. The second position capturing unit 28 is at least partly fixated to the rotary shaft 48. The second position capturing unit 28 is embodied as a rotary encoder. The second position capturing unit 28 is embodied as an absolute-value encoder. In the present case the first position capturing unit 26 and the second position capturing unit 28 are embodied at least partly in a one-part implementation. Alternatively it is also conceivable to have at least two position capturing units embodied in a one-part implementation and/or completely separate from each other. It is moreover conceivable to implement at least one position capturing unit as a relative-value encoder, in particular incremental encoder. Furthermore at least one position capturing unit could be arranged in a position that differs from a pivot axis.

The position capturing units 26, 28 are provided to detect an actual position of the transporting unit 16 and to feed said actual position to the control unit implemented as a digital signal. The control unit is provided to compare the digital signal to a required position of the transporting unit 16 that is stored in the memory unit, and to actuate the positioning unit 18 in such a way that the actual position of the transporting unit 16 is equivalent to the required position at least substantially. In the present case at least substantially any desired type of end positions of the transporting unit 16 may be stored and/or programmed in the memory unit of the control unit.

The winding device may moreover comprise further units. In the present case the winding device comprises a feed unit for carriers of material to be wound 24. The feed unit for carriers of material to be wound 24 is provided for storing carriers of material to be wound 14, 15 which are to be processed and for making these available for processing. For this purpose, the feed unit for carriers of material to be wound 24 comprises a feed opening for carriers of material to be wound 50, which is in particular arranged in the winding machine housing 34. The winding device also comprises a feed unit for material to be wound 52. The feed unit for material to be wound 52 is provided for rendering a material to be wound 10 available and for feeding the material to be wound 10 to the carrier of material to be wound 14, 15 (cf. also FIG. 2). For this purpose the feed unit for material to be wound 52 comprises in the present case at least one supplying unit 54 and a pulley 56 as well as an electrically adjustable traversing drive 58, which is in particular movable along the winding axis 38. To sever the material to be wound 10 the winding device further comprises a movably supported severing unit 60. Alternatively a supplying unit may also be embodied as a pulley. It is moreover conceivable to completely dispense with a supplying unit.

Beyond this the winding device comprises a foiling unit 62. The foiling unit 62 is provided for packaging a fully processed carrier of material to be wound 14, 15. For this purpose the foiling unit 62 comprises a receiving shaft 64 for receiving a foiling coil 66 (cf. also FIG. 2). The receiving shaft 64 is supported rotatably about a rotary axis 68. Moreover the foiling unit 62 comprises a foiler 70. The foiler 70 is provided to align a foil of the foiling coil 66 and to arrange the foil of the foiling coil 66 on the material to be wound 10 of the fully processed carrier of material to be wound 14, 15. For the purpose of function control and/or maintenance control, the foiling unit 62 furthermore comprises a foiler capturing unit 72. The foiler capturing unit 72 is provided to capture a movement of the foiling coil 66. The foiler capturing unit 72 is implemented as a rotary encoder. The foiler capturing unit 72 is embodied as a relative-value encoder, in particular as an incremental encoder. The foiler capturing unit 72 is arranged on the rotary axis 68. The foiler capturing unit 72 is at least partly fixated to the receiving shaft 64. Via the foiler capturing unit 72 a packaging process of the fully processed carrier of material to be wound 14, 15 can be monitored and controlled in a simple fashion. Herein a pre-defined quantity of foil may be arranged on the material to be wound 10 of the carrier of material to be wound 14, 15. In particular, by capturing the rotary movement of the foiling coil 66 it is advantageously detectable if a packaging process is executed and/or if an error occurs in the packaging process, e.g. in case the foil of the foiling coil 66 has been used up. Alternatively a foiler capturing unit could also be implemented as an absolute-value encoder, as a laser sensor and/or as another type of sensor deemed expedient by someone skilled in the art. It is also conceivable to arrange a foiler capturing unit in a different position and/or to entirely dispense with a foiler capturing unit.

FIG. 2 shows the winding device during a winding process, wherein the transporting unit 16 is in a winding operative position. In the present case the winding device serves to wind the material to be wound 10 onto the exchangeable carrier of material to be wound 14, 15. Alternatively it is also conceivable to use the winding machine for winding a material to be wound off a carrier of material to be wound. The material to be wound 10 is in the present case equivalent to a ribbon-shaped material to be wound. However, using other materials to be wound with a geometry differing from a ribbon-shape is also conceivable.

For the purpose of winding the material to wound 10, the winding mandrel 12 and thus the carrier of material to be wound 14, 15 is driven rotatingly about the winding axis 38. During a winding process, a mass of the material to be wound 10 that has already been wound onto the carrier of material to be wound 14, 15 is determined continuously and/or in discrete steps. For this purpose the control unit comprises a mass sensor (not shown), which is provided for determining a mass characteristic and/or the actual mass of the material to be wound 10 that has already been wound. Alternatively other sensors deemed expedient by someone skilled in the art are also conceivable for determining a wound material to be wound, e.g. a sensor for measuring a length of a material to be wound and/or a circumference sensor for determining a diameter of the material to be wound that has already been wound.

If a given quantity of a material to be wound 10 is located on the carrier of material to be wound 14, 15, the winding mandrel 12 is stopped and the wound material to be wound 10 is separated from the remaining material to be wound 10 by means of the severing unit 60. Then the wound material to be wound 10 is packaged by means of the foiling unit 62. Alternatively it is also conceivable to do without packaging by a foiling unit.

Then follows a setting-down process (cf. FIG. 3). In this setting-down process the transporting unit 16 is provided for transporting the fully processed carrier of material to be wound 14, 15 away out of the winding operative position into a storage place for carriers of material to be wound 74. The positioning unit 18 is herein provided for translationally displacing the transporting unit 16 out of the winding operative position into a setting-down operative position by means of an axial translational movement and a pivot movement. The setting-down operative position is in the present case at least substantially equivalent to at least substantially any kind of a spatial position, which may in particular change between two winding processes and depending on a quantity of material to be wound 10 that has already been wound. According to the invention, the spatial end position of the transporting unit 16 may herein be at least substantially adjusted according to requirement, as a result of which a manual position adaption of possible mechanical stops between the winding processes may be dispensed with. Alternatively it is also conceivable that a positioning unit is provided for translationally displacing a transporting unit, via an axial translational movement and a pivot movement, out of a receiving operative position and/or out of at least substantially any other desired position, preferably end position, of the transporting unit into a setting-down operative position.

When the carrier of material to be wound 14, 15 is removed, the carrier of material to be wound 14, 15 is entirely supported by the second mandrel unit 42. Firstly the transporting unit 16 and hence the carrier of material to be wound 14, 15 is in the winding operative position. In a first step the distance between the first mandrel unit 40 and the second mandrel unit 42 is increased. Herein the first positioning element 20 is provided to increase the axial position of the transporting unit 16 and thus of the second mandrel unit 42 with respect to the winding machine housing 34 and/or to the first mandrel unit 40. In a second step the second positioning element 22 is provided to change the pivot position of the transporting unit 16 by approximately 90°, in particular in a positive direction of rotation. In a third step the first positioning element 20 is provided to reduce the axial position of the transporting unit 16 with respect to the winding machine housing 34 and/or to the first mandrel unit 40 until the transporting unit 16 and thus the carrier of material to be wound 14, 15 is situated in the setting-down operative position. Then the force-fit connection between the second mandrel unit 42 and the carrier of material to be wound 14, 15 can be released, as a result of which the carrier of material to be wound 14, 15 is supported in the storage place for carriers of material to be wound 74.

Subsequently a receiving process follows (cf. FIG. 4). In this receiving process the transporting unit 16 is provided to receive a further carrier of material to be wound 14, 15, which is arranged in the feed unit for carriers of material to be wound 24 and is to be processed, from the feed unit for carriers of material to be wound 24 and to transport said further carrier of material to be wound 14, 15 into the winding operative position. The positioning unit 18 is herein provided for translationally displacing the transporting unit 16 out of the setting-down operative position into a receiving operative position via an axial translational movement and a pivot movement. The receiving operative position is in the present case equivalent to at least substantially any desired spatial position, which may in particular change depending on a carrier of material to be wound 14, 15 that is made use of. Alternatively it is also conceivable that a positioning unit is provided for translationally displacing a transporting unit out of a winding operative position and/or out of at least substantially any desired other position, preferably end position, of the transporting unit into a receiving operative position via an axial translational movement and a pivot movement.

When the further carrier of material to be wound 14, 15 is delivered, the further carrier of material to be wound 14, 15 is entirely supported by the second mandrel unit 42. In the present case the transporting unit is firstly located in the setting-down operative position.

In a first step the first positioning element 20 is provided to increase the axial position of the transporting unit 16 and thus of the second mandrel unit 42 with respect to the winding machine housing 34 and/or to the first mandrel unit 40, as a result of which the second mandrel unit 42 is removed in particular out of the carrier of material to be wound 14, 15. In a second step the second positioning element 22 is provided to change the pivot position of the transporting unit 16 by approximately 180°, in particular in a negative direction of rotation. In a third step the first positioning element 20 is provided to reduce the axial position of the transporting unit 16 with respect to the winding machine housing 34 and/or to the first mandrel unit 40 until the transporting unit 16 is located in the receiving operative position, as a result of which the second mandrel unit 42 is introduced into the further carrier of material to be wound 14, 15. Following this, a further force-fit connection may be established between the second mandrel unit 42 and the further carrier of material to be wound 14, 15, in particular via an actuation of the clamping jaws. In a fourth step the first positioning element 20 is provided to increase the axial position of the transporting unit 16 and thus of the second mandrel unit 42 with respect to the winding machine housing 34 and/or to the first mandrel unit 40, as a result of which the further carrier of material to be wound 14, 15 removed out of the feed unit for carriers of material to be wound 24. In a fifth step the second positioning element 22 is provided to change the pivot position of the transporting unit 16 by approximately 90°, in particular in a positive direction of rotation. In a final step the first positioning element 20 is provided to reduce the axial position of the transporting unit 16 with respect to the winding machine housing 34 and/or the first mandrel unit 40 until the transporting unit 16 and thus the further carrier of material to be wound 14, 15 is in the winding operative position, as a result of which a further winding process may take place.

The exemplary winding machine described and its functionality are herein provided just for exemplarily illustrating the invention and are absolutely not to be a restriction thereof.

The invention claimed is:

1. A winding device for winding a material to be wound, with a winding mandrel provided for carrying a carrier of material to be wound in a winding process, with a transporting unit on which at least a component of the winding mandrel is arranged, and with a positioning unit provided for changing a spatial position of the transporting unit, wherein the transporting unit is embodied as a pivot arm, wherein the positioning unit is provided for at least substantially adjusting a spatial end position of the transporting unit according to requirement, wherein the transporting unit is in at least one operating state provided for receiving a carrier of material to be wound which is arranged and is to be processed in a feed unit for carriers of material to be wound, and for transporting said carrier of material to be wound via an axial translational movement and a pivot movement, into a winding operative position, wherein at least one winding process is carried out, wherein the material to be wound is wound onto the carrier of material to be wound and/or is wound off from the carrier of material to be wound, wherein the transporting unit is in the winding operative position during the winding process.

2. The winding device according to claim 1, wherein the positioning unit comprises a first positioning element, which is provided for changing an axial position of the transporting unit.

3. The winding device according to claim 1, wherein the positioning unit comprises a second positioning element, which is provided for changing a pivot position of the transporting unit.

4. The winding device according to claim 1, wherein a maximum pivot angle of the transporting unit is at least 10°.

5. The winding device according to claim 1, wherein the transporting unit is in at least one operating state provided for transporting a processed carrier of material to be wound away out of a winding operative position.

6. The winding device according to claim 1, wherein the positioning unit comprises a first position capturing unit, which is provided for capturing an axial position of the transporting unit.

7. The winding device according to claim 1, wherein the positioning unit comprises a second position capturing unit, which is provided for capturing a pivot position of the transporting unit.

8. The winding device according to claim 6, wherein the first position capturing unit and the second position capturing unit are embodied at least partly in a one-part implementation.

9. The winding device according to claim 6, wherein at least one of the position capturing units is arranged on a pivot axis of the transporting unit.

10. The winding device according to claim 6, wherein at least one of the position capturing units is embodied as an absolute-value encoder.

11. The winding device according to claim 6, wherein at least one of the position capturing units is embodied as a relative-value encoder.

12. A winding machine with at least one winding device according to claim 1.

* * * * *